United States Patent [19]

Bertot

[11] 4,307,789

[45] Dec. 29, 1981

[54] INSTALLATION FOR CONTROLLING OPENABLE PANELS OF AN AUTOMOBILE VEHICLE

[75] Inventor: Maurice M. Bertot, Montbeliard, France

[73] Assignee: Aciers et Outillage Peugeot, Audincourt, France

[21] Appl. No.: 100,613

[22] Filed: Dec. 5, 1979

[30] Foreign Application Priority Data

Dec. 5, 1978 [FR] France ..... 78 34231

[51] Int. Cl.[3] ..... E05B 47/02

[52] U.S. Cl. ..... 180/289; 307/10 AT; 307/66

[58] Field of Search ..... 180/287, 286, 289; 307/10 AT, 10 BP, 66; 340/63, 64

[56] References Cited

U.S. PATENT DOCUMENTS

| | | | |
|---|---|---|---|
| Re. 28,142 | 9/1974 | Kazaoka | 180/289 |
| 4,006,450 | 2/1977 | Ofenleger | 307/10 AT X |
| 4,258,945 | 3/1981 | Pouget | 292/68 |

FOREIGN PATENT DOCUMENTS 1327088 4/1963 France .

*Primary Examiner*—Joseph F. Peters, Jr.
*Assistant Examiner*—Michael Mar
*Attorney, Agent, or Firm*—Sughrue, Mion, Zinn, Macpeak and Seas

[57] ABSTRACT

The installation comprises in each panel a latch which is opened by means of an electric control device. Each of the control devices is connected in series with at least one switch actuating this device in a panel circuit. All of the panel circuits are connected in parallel to a source of current through at least one switch for locking or unlocking simultaneously all the panels. The source of current comprises, in addition to the usual battery of the vehicle, a buffer battery connected in parallel and located in the passenger compartment of the vehicle, there being provided a blocking component such as a diode for precluding a possible discharging of the buffer battery into the usual main battery.

4 Claims, 1 Drawing Figure

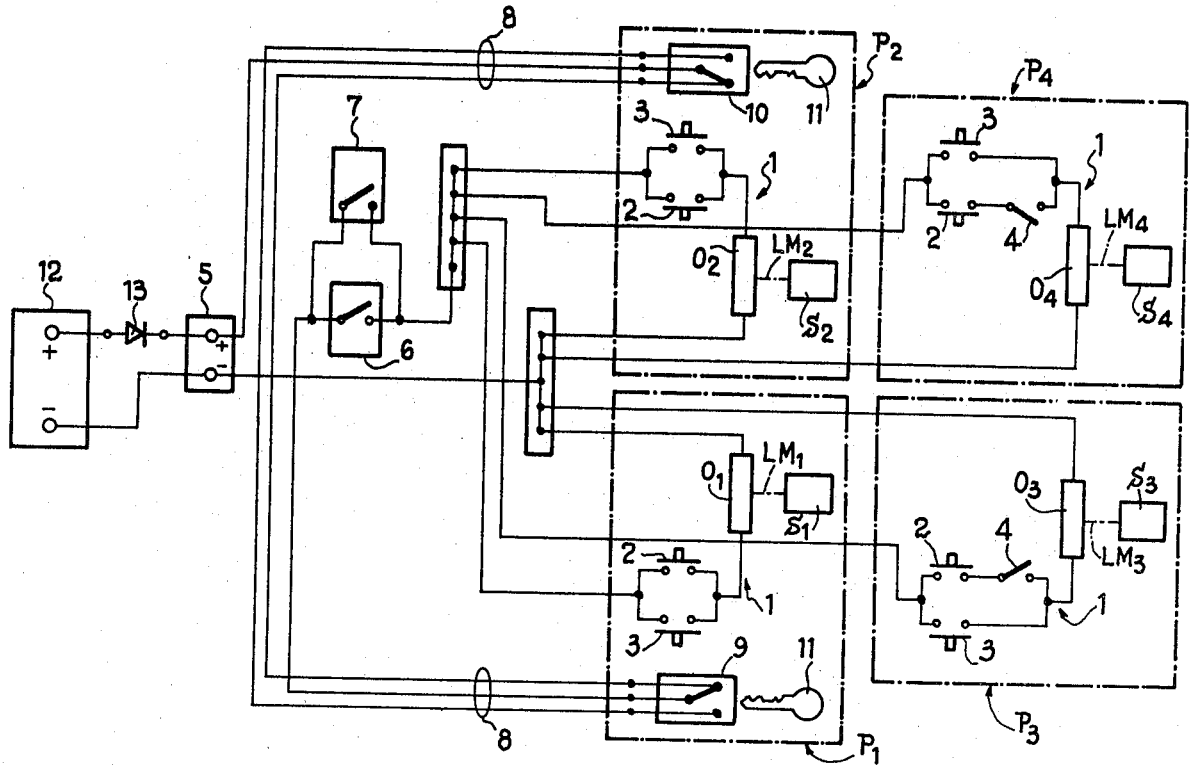
8
P2
P4
7
3
10
11
1
2
4
LM4
LM2
O2
O4
S2
S4
12
13
5
6
O1
LM1
S1
O3
S3
LM3
9
P1
P3

INSTALLATION FOR CONTROLLING OPENABLE PANELS OF AN AUTOMOBILE VEHICLE

DESCRIPTION

The present invention relates to the control of openable panels of an automobile vehicle, such as the doors, the lid of the rear luggage compartment, the sliding roof or other panels.

Such as installation has been disclosed in French Patent No 1,327,088. This installation comprises, in each openable panel, a latch the opening of which is achieved by means of an electric control device, each of said control devices being connected in series with at least one switch for actuating said device in a circuit for the openable panel, all the panel circuits being connected in parallel with a source of current through at least one switch for locking and unlocking simultaneously all the openable panels.

The source of current for this installation is formed by the supply network of the vehicle comprising the battery of the latter. The battery is usually provided in the engine compartment in a region which is exposed to shocks in the event of collision and, owing to the safety features incorporated in the bodies of modern vehicles, it is often in a region having the feature of being capable of progressively deforming for the purpose of protecting the passengers in the case of an accident. Under these conditions, the installation is no longer able to operate when the battery has been damaged and, if the doors where locked before the accident, the occupants of the vehicle are trapped and cannot be aided effectively.

An object of the invention is to overcome this serious defect of the installation of the prior art.

According to the invention, there is provided an installation for controlling openable panels of an automobile vehicle, wherein the source of current comprises, in addition to the conventional main battery of the vehicle, a buffer battery connected in parallel and located in the passenger compartment of the vehicle, a blocking component such as a diode being connected between said batteries in order to preclude a possible discharging of the buffer battery into said main battery.

Owing to these features, the control installation is always supplied with current for a sufficiently long period of time for unlocking the doors in the event of break-down of the main battery.

Further features of the invention will be apparent from the ensuing description which is given merely by way of example with reference to the accompanying drawing in which:

The single FIGURE shows an electric diagram of a preferred embodiment of the control installation according to the invention.

As shown in the FIGURE, each openable panel $P_1$ to $P_4$ of the automobile vehicle comprises an electric control device $O_1$ to $O_4$ which acts through a mechanical connection $LM_1$ to $LM_4$ on a latch $S_1$ to $S_4$ the opening of which is controlled by said device. The latter may have a direct action on the latch and may be in this case a linear or rotary electromagnet, an electric motor or the like. However, by way of a modification, the action of the control device may be indirect. For example, it may concern a pneumatic or hydraulic electrically-operated valve combined with a cylinder device or like control device. The latches $S_1$ to $S_4$ may be of any suitable type. Advantageously, they may be formed by the latch described in commonly assigned U.S. Pat. No. 4,258,945. Thus, the openable panel provided with these devices may be opened by the excitation of the electric control device, the closure thereof being achieved merely by the action of the user on the panel.

In the FIGURE, the panels $P_1$ to $P_4$ represent, by way of example, respectively, the left front door, the right front door, the left rear door and the right rear door. In order to simplify the drawing, only the doors of the vehicle have been shown, but it will be easily understood that other panels of the vehicle, such as the lid of the rear luggage compartment, the sliding roof, the fuel cap and other panels may be equipped in the same way with a latch and its actuating device inserted in the circuit of the installation of the invention.

Each door $P_1$ to $P_4$ comprises a series circuit 1 including the control device $O_1$ to $O_4$ therefor and a circuit in which an inner switch 2 and an outer switch 3 are connected in parallel, each of said switches being formed by a normally-open fleeting action switch. The series circuits 1 of the rear doors $P_3$ and $P_4$ further comprise a switch 4 having a permanent action, or having two stable positions, connected in series with the inner switch 2, this switch performing, when it is open, a "child safety" function as explained hereinafter.

According to the invention, one of the terminals of each series circuit 1 is connected, in common with the corresponding terminals of the other circuits, to the negative terminal of a buffer battery 5 whose function will be described later. The opposite terminal of each series circuit is connected, in common with the corresponding terminals of the other series circuits 1, to a locking and unlocking switch 6 which is placed inside the vehicle, for example on the dashboard. This switch has a permanent action, or two stable positions, and is connected in parallel with a safety switch 7 which is normally open and closes under the action of a phenomenon associated with the imminence of an accident, such as a switch responsive to accelerations or decelerations.

The switch 2 is connected to a two-way circuit 8 comprising two outer locking and unlocking switches 9 and 10. These switches 9 and 10 are in the form of inverting switches having two stable positions and may be actuated by a key 11, each of the front doors $P_1$ and $P_2$ being provided with such a switch (it will be understood that the switches 9 and 10 may be arranged in such manner as to be actuatable by means other than a key, such as a printed circuit, perforated card, coded card or "badge" etc.). The connecting terminal of the two-way switch 8 opposed to the inner switch 6 is connected to the positive terminal of the battery 5.

This buffer battery 5 is connected in parallel to a battery 12 which is the main source of current of the vehicle, a diode or other blocking component 13 being connected between the two positive terminals of the batteries so as to ensure that the battery 5 does not discharge into the main battery 12 in the event of a drop in the voltage of the latter, or an accidental earthing of the positive part of the circuit, etc.

The buffer battery is provided in order to act as a substitute in the event of break down of the main battery 12 or the destruction of the latter in the case of an accident. Further, it permits access to the vehicle in the course of maintenance, repairs and check-ups when the main battery 12 is disconnected. It may be easily placed in a region of the vehicle which is only slightly exposed to destruction, or less exposed than in the engine compartment in which the main battery is usually located. A preferred place for this buffer battery is under the seat of one of the front passengers of the vehicle. The buffer battery 5 must be chosen in such manner that it is incapable of giving off unpleasant or harmful gaseous or liquid substances both as concerns normal operation and in the case of accident (shocks, overturning etc.).

The actuation of one of the switches 9 or 10 by means of a key 11 supplies all of the series circuits 1 with current, the switch 6 being of course placed in its closed position when the user previously left his vehicle.

The unlocking thus achieved allows the opening of any of the doors $P_1$ to $P_4$, since each control device $O_1$ to $O_4$ can be excited by the associated outer switches 3.

When he is installed in his vehicle, the user can again simultaneously lock all of the doors by opening the switch 6 which is placed on the dashboard. Further, as a safety measure, he can also prevent the opening, by means of the inner switches 2, of the rear doors $P_3$ and $P_4$ by opening one or both child safety switches 4, which leaves the action on these inner switches without effect.

The locking achieved by the opening of the switch 6 may be cancelled by the switch 7 which becomes operative in the event of an accident, as already mentioned hereinbefore. Thus, the passengers may leave the passenger compartment if they are conscious and the rescuers can have access to the passenger compartment by actuating the switches 3.

In order to avoid fear on the part of the passengers of a vehicle of remaining locked in and, in order to overcome any break-down of the installation of the invention, it is possible to provide in each door a simple mechanical control device for opening the door (for example the closed-door indicator normally provided). Thus, a rapid evacuation of the vehicle is always possible even if the front passengers are unconscious, the dashboard is destroyed to an extent that the switch 6 can no longer be actuated or the safety switch is destroyed.

In addition to the advantages of the installation of the invention mentioned hereinbefore, the following features may be mentioned:

the possibility of breaking into the vehicle is reduced since, even in the case of the breakage of a door window, the door cannot be opened without actuating the switch 9 or 10;

the mechanisms within the doors are much simplified relative to those of known type so that there is less risk of break-down, a saving of space in the doors, an elimination of disturbing vibrations, a reduction in weight etc.;

the general locking of the openable panels is always ensured, even in the case of accident when the vehicle is stationary ;

it is possible to have access to the vehicle and to lock all the panels even in the event of close parking when only one side of the vehicle is accessible.

Having now described my invention what I claim as new and desire to secure by Letters Patent is:

1. An installation for controlling openable panels of an automobile vehicle, such as passenger compartment doors, comprising: for each openable panel, a latch (S) and an electric control device (0) for controlling the opening of the corresponding latch, each of said control devices being connected in series with at least one actuating switch (2, 3) for said device in an openable panel circuit, a circuit connecting all of the openable panel circuits in parallel with a source of current through at least one switch (6) for simultaneously locking and unlocking all the openable panels; said source of current comprising a conventional main battery (12) of the vehicle, a buffer battery (5) located in the passenger compartment, a circuit connecting the buffer battery in parallel with the main battery, and a current-blocking component (13) inserted in said circuit connecting the buffer battery in parallel with the main battery for precluding any discharge of the buffer battery into said main battery, and a two-way switch circuit (8) comprising two inverting type locking and unlocking switches (9, 10) connecting said buffer battery to the circuit connecting all of the openable panel circuits in parallel, said inverting type locking and unlocking switches being respectively mounted in opposite, preferably front, doors of said passenger compartment.

2. An installation as claimed in claim 1, wherein said at least one locking and unlocking switch is mounted inside the vehicle, preferably on a dashboard thereof, and is connected in series with said two-way switch circuit.

3. An installation as claimed in claim 2, wherein at least one switch of a control device, preferably an inner switch (4) located in a rear door of the passenger compartment, is connected in series with an inhibiting switch.

4. An installation as claimed in claim 2 or 3, further comprising a switch (7) which responds when a phenomenon indicating a dangerous situation occurs, said responsive switch being connected in parallel with the locking and unlocking switch located inside the vehicle to override the latter switch.

* * * * *